US008843055B2

(12) United States Patent
Matsumoto et al.

(10) Patent No.: US 8,843,055 B2
(45) Date of Patent: Sep. 23, 2014

(54) IMAGE FORMING APPARATUS IMPROVED IN OPERABILITY FOR PRINT JOB INVOLVING SINGLE-SIDED PRINTING AND DOUBLE-SIDED PRINTING

(75) Inventors: Hidenori Matsumoto, Kashiwa (JP); Takayuki Fujii, Tokyo (JP); Akinobu Nishikata, Abiko (JP); Hiroshi Matsumoto, Toride (JP); Katsuya Nakama, Kashiwa (JP)

(73) Assignee: Canon Kabushiki Kaisha (JP)

( * ) Notice: Subject to any disclaimer, the term of this patent is extended or adjusted under 35 U.S.C. 154(b) by 258 days.

(21) Appl. No.: 13/108,448

(22) Filed: May 16, 2011

(65) Prior Publication Data

US 2011/0280643 A1 Nov. 17, 2011

(30) Foreign Application Priority Data

May 17, 2010 (JP) ..... 2010-113127

(51) Int. Cl.

| | |
|---|---|
| ***G03G 15/00*** | (2006.01) |
| ***B65H 85/00*** | (2006.01) |
| ***B41J 3/60*** | (2006.01) |
| ***G03G 15/23*** | (2006.01) |

(52) U.S. Cl.

CPC ..... *B41J 3/60* (2013.01); *G03G 15/234* (2013.01); *G03G 15/50* (2013.01)

USPC ..... 399/401; 347/104

(58) Field of Classification Search

CPC ..... G03G 15/00; B65H 85/00

See application file for complete search history.

(56) References Cited

U.S. PATENT DOCUMENTS

| | | | | |
|---|---|---|---|---|
| 4,978,980 | A | 12/1990 | Noguchi et al. | |
| 5,196,897 | A * | 3/1993 | Trask | 399/364 |
| 8,229,315 | B2 * | 7/2012 | Sakai | 399/85 |
| 2003/0063936 | A1 * | 4/2003 | Sasaki et al. | 399/401 |

(Continued)

FOREIGN PATENT DOCUMENTS

| | | | | |
|---|---|---|---|---|
| JP | 03067674 A * | 3/1991 | ..... | G03G 15/00 |
| JP | 05-193212 A | 8/1993 | | |

(Continued)

OTHER PUBLICATIONS

Russian Official Action issued Aug. 20, 2012 for RU 2011119592 (English translation provided).

(Continued)

*Primary Examiner* — Nguyen Ha

(74) *Attorney, Agent, or Firm* — Rossi, Kimms & McDowell LLP

(57) ABSTRACT

An image forming apparatus capable of improving productivity in a print job mixedly involving single-sided printing and double-sided printing. Sheets are fed one by one to an image forming section. When double-sided printing is to be performed, a sheet having an image formed on the first side thereof by the image forming section is re-fed thereto so as to have an image formed on the second side thereof. When a sheet for double-sided printing exists, which is posterior in page order to a sheet for single-sided printing, an image forming order is changed such that the first side of the sheet for double-sided printing is subjected to image formation prior to the sheet for single-sided printing. When it is predicted that a state will occur in which the sheet for single-sided printing cannot be fed, the image forming order is not changed.

6 Claims, 15 Drawing Sheets

(56) References Cited

U.S. PATENT DOCUMENTS

| | | | | |
|---|---|---|---|---|
| 2004/0047661 | A1* | 3/2004 | Weinlich et al. | 399/381 |
| 2008/0166165 | A1* | 7/2008 | Mohri | 399/397 |
| 2009/0148213 | A1* | 6/2009 | Masuda | 399/401 |
| 2009/0317120 | A1* | 12/2009 | Miyahara | 399/82 |
| 2010/0110483 | A1* | 5/2010 | Igarashi | 358/1.15 |
| 2010/0166441 | A1* | 7/2010 | Kobayashi | 399/35 |
| 2010/0189458 | A1* | 7/2010 | Miyahara | 399/82 |
| 2010/0196042 | A1 | 8/2010 | Tsujita | |
| 2010/0296831 | A1* | 11/2010 | Sakai | 399/85 |
| 2012/0262514 | A1* | 10/2012 | Hara et al. | 347/16 |
| 2013/0202338 | A1* | 8/2013 | Matsumoto et al. | 399/364 |
| 2013/0336698 | A1* | 12/2013 | Noguchi et al. | 400/76 |

FOREIGN PATENT DOCUMENTS

| | | | | | |
|---|---|---|---|---|---|
| JP | 2001282050 | A | * | 10/2001 | B65H 85/00 |
| JP | 2004-145218 | A | | 5/2004 | |
| JP | 2004145218 | A | * | 5/2004 | |
| JP | 2007017656 | A | * | 1/2007 | G03G 15/00 |
| JP | 2007-065377 | A | | 3/2007 | |
| JP | 2007310055 | A | * | 11/2007 | G03G 15/00 |
| JP | 2010-076418 | A | | 4/2010 | |

OTHER PUBLICATIONS

Korean Office Action for corresponding KR 10-2011-0046411, mail date Dec. 26, 2013.

* cited by examiner

*FIG.8*

| IMAGE FORMING ORDER | PAGE No. | JOB |
|---|---|---|
| 1 | P11 | DOUBLE-SIDED PRINTING SHEET S1 (FRONT) |
| 2 | P12 | DOUBLE-SIDED PRINTING SHEET S1 (REVERSE) |
| 3 | P2 | SINGLE-SIDED PRINTING SHEET S2 |
| 4 | P31 | DOUBLE-SIDED PRINTING SHEET S3 (FRONT) |
| 5 | P32 | DOUBLE-SIDED PRINTING SHEET S3 (REVERSE) |
| 6 | P4 | SINGLE-SIDED PRINTING SHEET S4 |
| 7 | P51 | DOUBLE-SIDED PRINTING SHEET S5 (FRONT) |
| 8 | P52 | DOUBLE-SIDED PRINTING SHEET S5 (REVERSE) |

FIG.11

| IMAGE FORMING ORDER | PAGE No. | JOB |
|---|---|---|
| 1 | P11 | DOUBLE-SIDED PRINTING SHEET S1 (FRONT) |
| 2 | P31 | DOUBLE-SIDED PRINTING SHEET S3 (FRONT) |
| 3 | P51 | DOUBLE-SIDED PRINTING SHEET S5 (FRONT) |
| 4 | P12 | DOUBLE-SIDED PRINTING SHEET S1 (REVERSE) |
| 5 | P2 | SINGLE-SIDED PRINTING SHEET S2 |
| 6 | P32 | DOUBLE-SIDED PRINTING SHEET S3 (REVERSE) |
| 7 | P4 | SINGLE-SIDED PRINTING SHEET S4 |
| 8 | P52 | DOUBLE-SIDED PRINTING SHEET S5 (REVERSE) |

IMAGE FORMING APPARATUS IMPROVED IN OPERABILITY FOR PRINT JOB INVOLVING SINGLE-SIDED PRINTING AND DOUBLE-SIDED PRINTING

BACKGROUND OF THE INVENTION

1. Field of the Invention

The present invention relates to an image forming apparatus which is capable of performing double-sided printing and outputting a job mixedly involving single-sided printing and double-sided printing at a high speed.

2. Description of the Related Art

Conventionally, to perform efficient double-sided printing on sheets, U.S. Pat. No. 4,978,980 has proposed the following method: First-side image formation is continuously performed on a predetermined number of sheets, and then, after the sheets each having an image formed on a first side thereof are circulated through a double-sided conveying path, second-side image formation on the sheets and first-side image formation on newly fed sheets are alternately performed (which is called "alternate sheet feed").

Further, in the field of commercial printing, a print job mixedly involving single-sided printing and double-sided printing is generally handled as one set, and high-speed output is demanded of such a job. In the control method disclosed in U.S. Pat. No. 4,978,980, it takes time from completion of image formation on the front side of a first sheet for double-sided printing to start of image formation on the reverse side of the sheet having been circulated through the double-sided conveying path. Whenever single-sided printing is switched to double-sided printing, the certain time is taken, and hence total printing speed is considerably reduced.

To solve this problem, Japanese Patent Laid-Open Publication No. 2004-145218 has proposed the following method: the first-side page of a double-sided printing sheet following a single-sided printing page group is subjected to image formation prior to the single-sided printing page group, the double-sided printing sheet is moved into a double-sided conveying path and kept on standby, and then the single-sided printing page group is printed and discharged. Thereafter, the second-side page of the double-sided printing sheet, remaining to be printed, is printed and then the sheet is discharged. Thus, a job mixedly involving single-sided printing and double-sided printing is output at a high speed.

As described above, only the first side of the double-sided printing sheet, which is to be output as a page following the single-sided printing page group, is printed prior to the single-sided printing page group, and then the single-sided printing is executed. This makes it possible to execute single-sided printing in parallel with double-sided printing, while making effective use of a time period over which a sheet having undergone first-side image formation for double-sided printing is conveyed through the double-sided conveying path, whereby total printing time can be reduced dramatically in comparison with the conventional methods.

A description will be given, with reference to FIG. 3, of an exemplary case where a job is executed for printing one double-sided printing sheet (sheet S1), one single-sided printing sheet (sheet S2), one double-sided printing sheet (sheet S3), one single-sided printing sheet (sheet S4), and one double-sided printing sheet (sheet S5) in the mentioned order. In FIG. 3, the front and reverse pages of the sheet S1 are denoted by P11 and P12, respectively, the page of the sheet S2 by P2, the front and reverse pages of the sheet S3 by P31 and P32, respectively, the page of the sheet S4 by P4, and the front and reverse pages of the sheet S5 by P51 and P52.

As shown in the upper part of FIG. 3, in a case where the pages are subjected to image formation in the page order, sheet conveyance time is needed between front-side image transfer and reverse-side image transfer, i.e. between image transfer on the page P11 and image transfer on the page P12, between image transfer on the page P31 and image transfer on the page P32, and between image transfer on the page P51 and image transfer on the page P52, and therefore a time interval between image forming operations increases. To solve this problem, the pages P31 and P51 for double-sided printing are subjected to image formation prior to the page P2 for single-sided printing, as shown in the lower part of FIG. 3, whereby it is possible to perform single-sided printing while making effective use of the sheet conveyance time between front-side image transfer and reverse-side image transfer, to thereby reduce the total printing time (this control will be hereinafter referred to as "the passing control").

Now, let it be assumed that in the above-mentioned passing control, a state (e.g. a sheet-absent state) has occurred in which sheets for use in single-sided printing cannot be fed after an image has been formed on each of the front sides of respective sheets for double-sided printing, prior to single-sided printing, as shown in FIG. 4. In this case, when reverse-side image formation for double-sided printing prior to single-sided printing is continued, a product without passed pages for single-sided printing is created. In short, the printed pages come to be out of order. Therefore, it is required to stop the printing operation, but if the printing operation is stopped, the sheets S3 and S5 are left in the apparatus, and hence the operator has to remove the sheets, which degrades operability.

If the sheets S3 and S5 are left on the conveying path until sheets for the passed or overtaken single-sided printing page can be fed, the sheets S3 and S5 can curl on the bent conveying path and become unusable as products. Therefore, it is required to remove the sheets S3 and S5.

Further, there is a case where due to a change of image forming conditions between pages, the pages cannot be continuously printed or printing thereof is temporarily suspended. For example, a target temperature of a fixing device can be changed when single-sided printing on a plain sheet is switched to double-sided printing on a thick sheet. Further, an adjustment operation for maintenance of image quality can be performed when single-sided printing in a monochrome printing mode is switched to double-sided printing in a full-color printing mode.

In such a case, if the first sides of respective sheets for double-sided printing are printed prior to a single-sided printing page group, printing conditions are changed between printing on the first side of each double-sided printing sheet and printing on the second side of the same, which can cause differences in color hue and glossiness between the front and reverse sides of the sheet.

SUMMARY OF THE INVENTION

The present invention provides an image forming apparatus which is capable of improving not only productivity in a print job mixedly involving single-sided printing and double-sided printing but also operability in a case where it is predicted that the print job will be suspended.

Further, the present invention provides an image forming apparatus which is capable of not only improving productivity in a print job mixedly involving single-sided printing and double-sided printing but also suppressing differences in image quality between the front and reverse sides of a sheet.

In a first aspect of the present invention, there is provided an image forming apparatus comprising an image forming section configured to form an image on a sheet, a sheet feeding section configured to contain a plurality of sheets and feed the contained sheets one by one to the image forming section, a re-feeding section configured to be operable when double-sided printing is to be performed, to re-feed a sheet fed from the sheet feeding section and having an image formed on a first side thereof by the image forming section to the image forming section so as to have an image formed on a second side thereof, and a control section configured to be operable when there is a sheet for double-sided printing, which is posterior in page order to a sheet for single-sided printing, to perform a changing of an image forming order such that a first side of the sheet for double-sided printing is subjected to image formation prior to the sheet for single-sided printing, wherein when it is predicted that a state will occur in which the sheet for single-sided printing, which is to have the image forming order changed, cannot be fed, the control section does not perform the changing of the image forming order.

In a second aspect of the present invention, there is provided an image forming apparatus comprising an image forming section configured to form an image on a sheet, a sheet feeding section configured to contain a plurality of sheets and feed the contained sheets one by one to the image forming section, a re-feeding section configured to be operable when double-sided printing is to be performed, to re-feed a sheet fed from the sheet feeding section and having an image formed on a first side thereof by the image forming section to the image forming section so as to have an image formed on a second side thereof, and a control section configured to be operable when there is a sheet for double-sided printing, which is posterior in page order to a sheet for single-sided printing, to perform a changing of an image forming order such that a first side of the sheet for double-sided printing is subjected to image formation prior to the sheet for single-sided printing, wherein when it is predicted that an image forming condition for forming an image on the sheet for single-sided printing, which is to have the image forming order changed, will be changed, the control section does not perform the changing of the image forming order.

Further features of the present invention will become apparent from the following description of exemplary embodiments with reference to the attached drawings.

BRIEF DESCRIPTION OF THE DRAWINGS

FIG. 8 is an example of a table showing an image forming order, which is useful in explaining normal control executed by the image forming apparatus.

FIG. 11 is a table showing an example of an image forming order in passing control executed by the image forming apparatus.

DETAILED DESCRIPTION OF THE EMBODIMENTS

Figure 1:
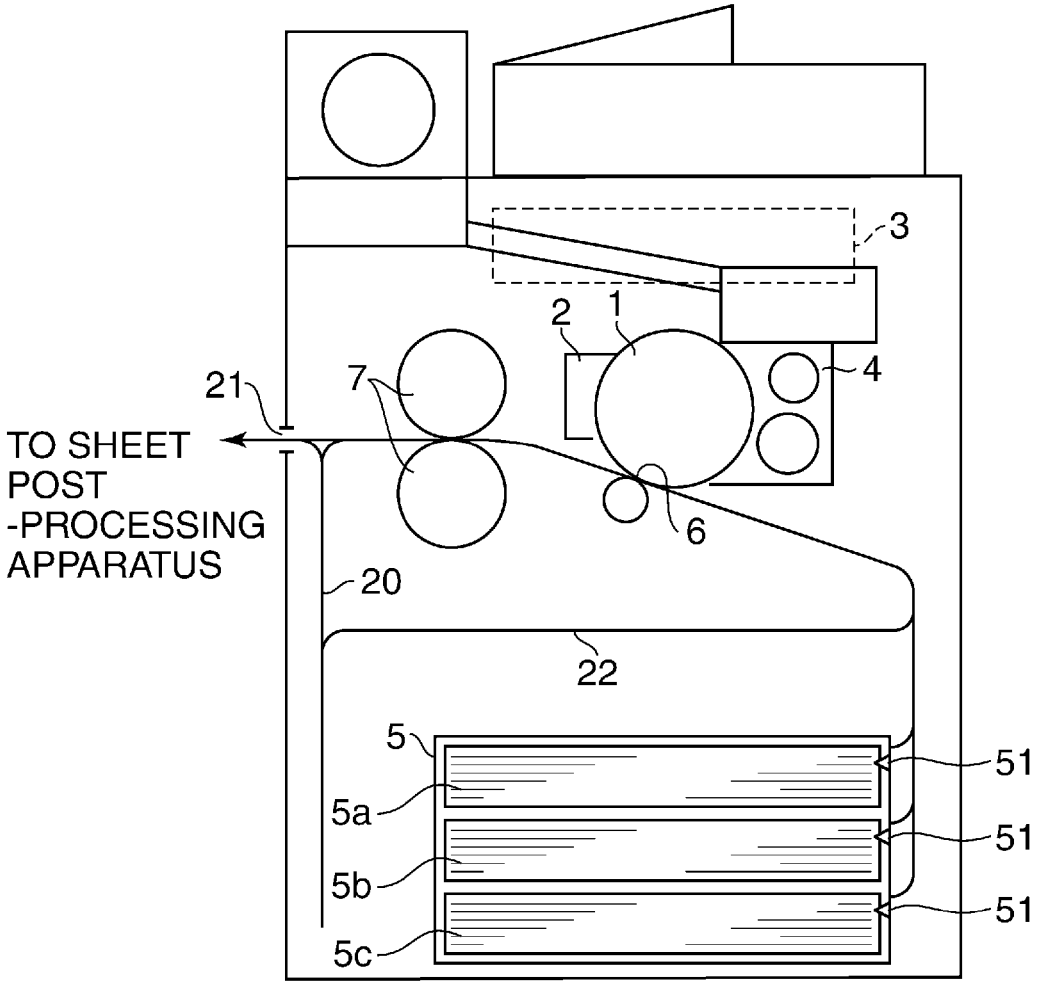
FIG. 1 is a schematic cross-sectional view of an image forming apparatus according to an embodiment of the present invention.

The present invention will now be described in detail below with reference to the accompanying drawings showing embodiments thereof. FIG. 1 is a schematic cross-sectional view of an image forming apparatus according to an embodiment of the present invention.

Referring to FIG. 1, a photosensitive drum 1 as an image bearing member as a component of an image forming unit is rotatably supported in the apparatus. Around the photosensitive drum 1, there are arranged a corona charger 2, a laser exposure optical system 3, and a developing device 4.

A toner image is formed on the photosensitive drum 1 using well-known electrophotography.

Sheets are fed one by one from a container 5 comprising sheet feeders 5*a*, 5*b*, and 5*c* and are further conveyed to a transfer section 6. A sheet having a toner image transferred thereon by the transfer section 6 is conveyed to a heating roller fixing device 7, and the toner image is fixed on the sheet. Then, the sheet is discharged from a discharge port 21 into a sheet post-processing apparatus disposed outside the image forming apparatus.

Figure 2:
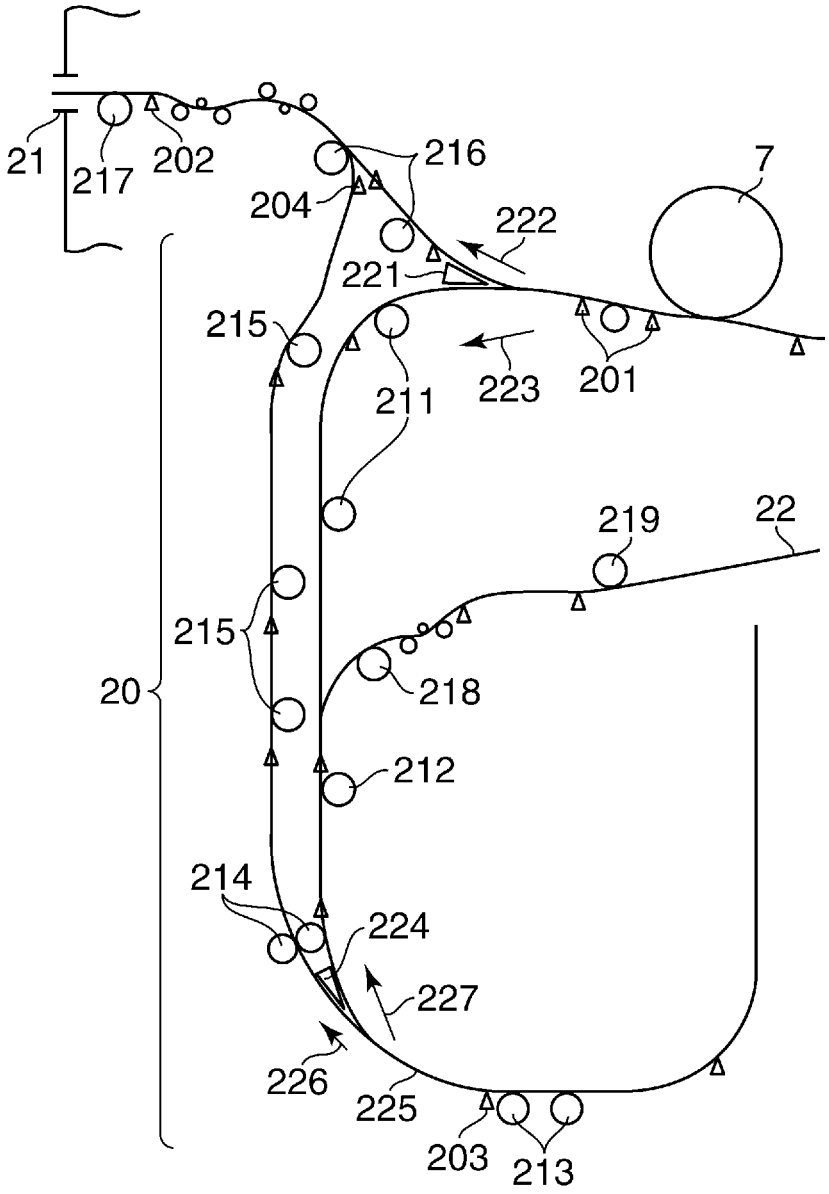
FIG. 2 is a view of an inversion section of the image forming apparatus.
Figure 3:
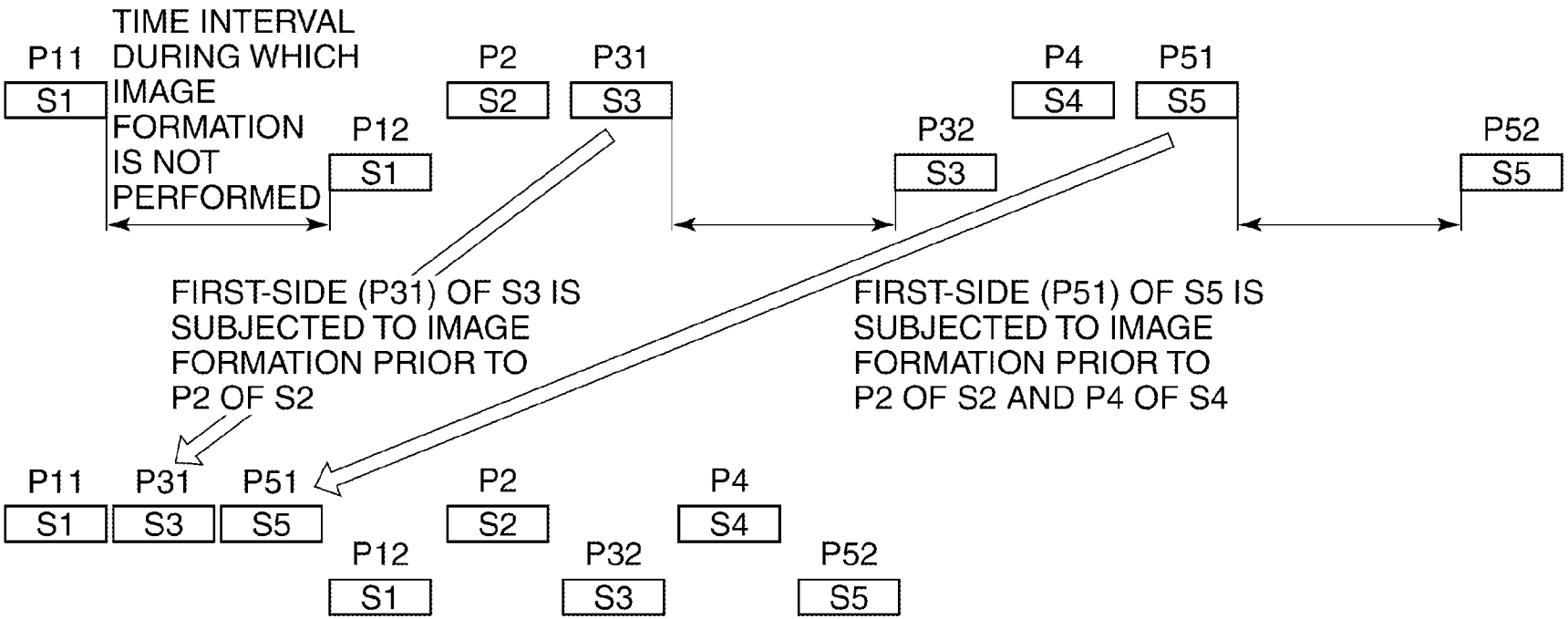
FIG.3 (PRIOR ART)
FIG. 3 is a schematic diagram useful in explaining passing control executed in the prior art.
Figure 4:
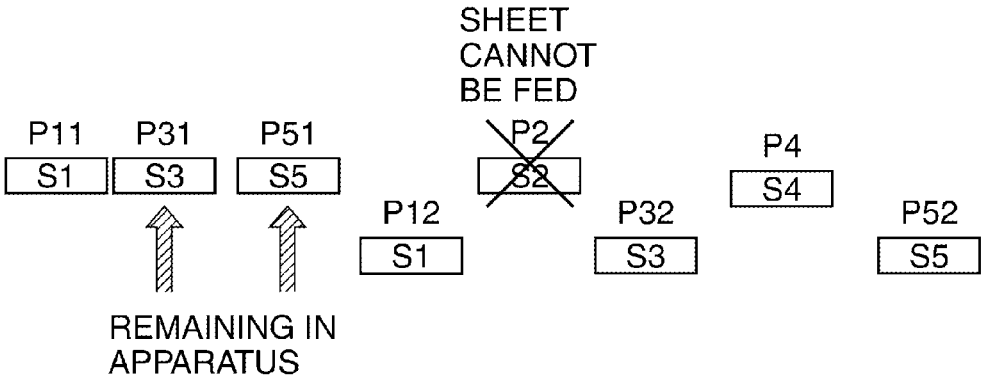
FIG.4 (PRIOR ART)
FIG. 4 is a schematic diagram useful in explaining a problem in the passing control executed in the prior art.

FIG. 2 is a view illustrating details of part of the image forming apparatus downstream of the fixing device 7.

The image forming apparatus is provided with a re-feeding mechanism that operates, when double-sided printing is to be performed on a sheet as a recording medium, to re-feed the sheet having an image formed on the first side thereof to the transfer section 6 so as to form an image on the second side of the sheet. Each of conveyor sensors 201, a discharge sensor 202, an inversion sensor 203, and conveyor sensors 204 detects whether or not a sheet is present. Each of these sensors is configured to be capable of detecting arrival of the leading end of a sheet at an associated sensor position and leaving of the trailing end of the sheet from the sensor position.

Conveying rollers 211 to 219 including inversion roller 213 are driven to convey a sheet in respective predetermined directions. The conveying rollers 211 are driven to convey a sheet from the fixing device 7 toward the inversion rollers 213.

The conveying roller 212 is driven to convey a sheet received from the conveying rollers 211 toward the inversion rollers 213 within an inversion and conveying path 20. Further, to convey the sheet inverted by the inversion rollers 213 toward a double-sided path 22, the conveying roller 212 is driven for reverse rotation.

The inversion rollers 213 draw in a sheet conveyed from the fixing device 7, and then performs reverse rotation to convey the sheet toward the double-sided path 22 or the discharge port 21. The conveying rollers 214 and 215 convey a sheet received from the inversion rollers 213 toward the discharge port 21 through the inversion and conveying path 20.

The conveying rollers 216 convey a sheet conveyed from the fixing device 7 without passing through the inversion rollers 213, and a sheet conveyed from the conveying rollers 214 and 215 via the inversion rollers 213, toward the discharge port 21. The conveying roller 217 conveys a sheet out of the image forming apparatus via the discharge port 21. The conveying rollers 218 and 219 convey a sheet inverted by the inversion rollers 213 for double-sided printing into the double-sided path 22.

A flapper 221 is shifted such that a sheet having passed through the fixing device 7 is conveyed either in a direction 223 or in a direction 222. A flapper 224 is shifted such that a sheet inverted by the inversion rollers 213 is conveyed either in a direction 227 or in a direction 226.

In the case of discharging a sheet face-up, i.e. with an image-formed surface thereof facing upward, from the image forming apparatus, the flapper 221 is shifted such that the sheet having passed through the fixing device 7 is conveyed in the direction 222. Then, the sheet passes through the conveying rollers 216 and 217 to be discharged from the discharge port 21 into the sheet post-processing apparatus outside the image forming apparatus. This sheet discharging method will be referred to as the straight sheet discharge.

In the case of discharging a sheet face-down, i.e. with an image-formed surface thereof facing downward, from the image forming apparatus, the flapper 221 is shifted such that the sheet having passed through the fixing device 7 is conveyed in the direction 223. Then, the sheet is conveyed into an inversion path 225 via the rollers 211, 212, and 213.

When the inversion sensor 203 detects the leading end of the sheet conveyed into the inversion path 225, the inversion rollers 213 convey the sheet by an amount corresponding in time to the length of the sheet. Thereafter, the inversion rollers 213 perform reverse rotation to convey (switch back) the sheet in the direction 226. At this time, the flapper 224 is shifted such that the sheet is conveyed in the direction 226. Then, the sheet passes through the rollers 214, 215, and 216 to be discharged from the discharge port 21 into the sheet post-processing apparatus outside the image forming apparatus. This sheet discharging method will be referred to as the inversion sheet discharge.

Next, a description will be given of a sheet conveyance control for double-sided printing. A sheet having an image formed on its front side passes through the fixing device 7, and then is conveyed to the inversion rollers 213. Control performed until the sheet is conveyed to the inversion rollers 213 is the same as in the inversion sheet discharge. Thereafter, the sheet is switched back by the inversion rollers 213, and then the flapper 224 is shifted such that the sheet is conveyed in the direction 227. Then, the sheet is conveyed into the double-sided path 22 via the rollers 212, 218, and 219. On the double-sided path 22, a plurality of sheets can be kept on standby in respective different positions.

The sheet conveyed into the double-sided path 22 has a toner image transferred on the second side thereof in the transfer section 6 as on the first side thereof, and the toner image is fixed again by the heating roller fixing device 7. The sheet subjected to double-sided printing is discharged by the straight sheet discharge after passing through the fixing device 7.

Figure 5:
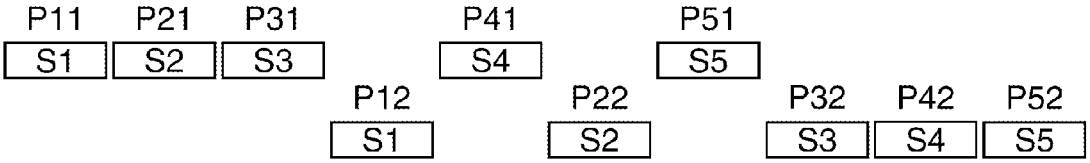
FIG. 5 is a schematic diagram useful in explaining an example of double-sided printing execute by the image forming apparatus.

Now, a description will be given of a printing order set in the case of performing double-sided printing on a plurality of sheets. FIG. 5 illustrates an exemplary case where double-sided printing is performed on five sheets. It should be noted that three sheets can be kept on standby on the double-sided path 22.

The five sheets are represented by S1, S2, S3, S4, and S5, respectively, and pages corresponding to the respective front and reverse sides of the sheet S1 are represented by P11 and P12, pages corresponding to the respective front and reverse sides of the sheet S2 by P21 and P22, pages corresponding to the respective front and reverse sides of the sheet S3 by P31 and P32, pages corresponding to the respective front and reverse sides of the sheet S4 by P41 and P42, and pages corresponding to the respective front and reverse sides of the sheet S5 by P51 and P52. First, the first sides of respective sheets that can be kept on standby on the double-sided path 22 are printed. In the present example, three sheets can be kept on standby on the double-sided path 22, and therefore the pages P11, P21, and P31 are printed. Then, the page P12, i.e. the second side of the first sheet is printed, whereafter first-side printing and second-side printing are alternately repeated. After printing on the first-side page P51 of the fifth sheet is completed, the second-side pages P32, P42, and P52 of the respective sheets S3, S4, and S5 having been kept on standby are continuously printed.

Figure 6:
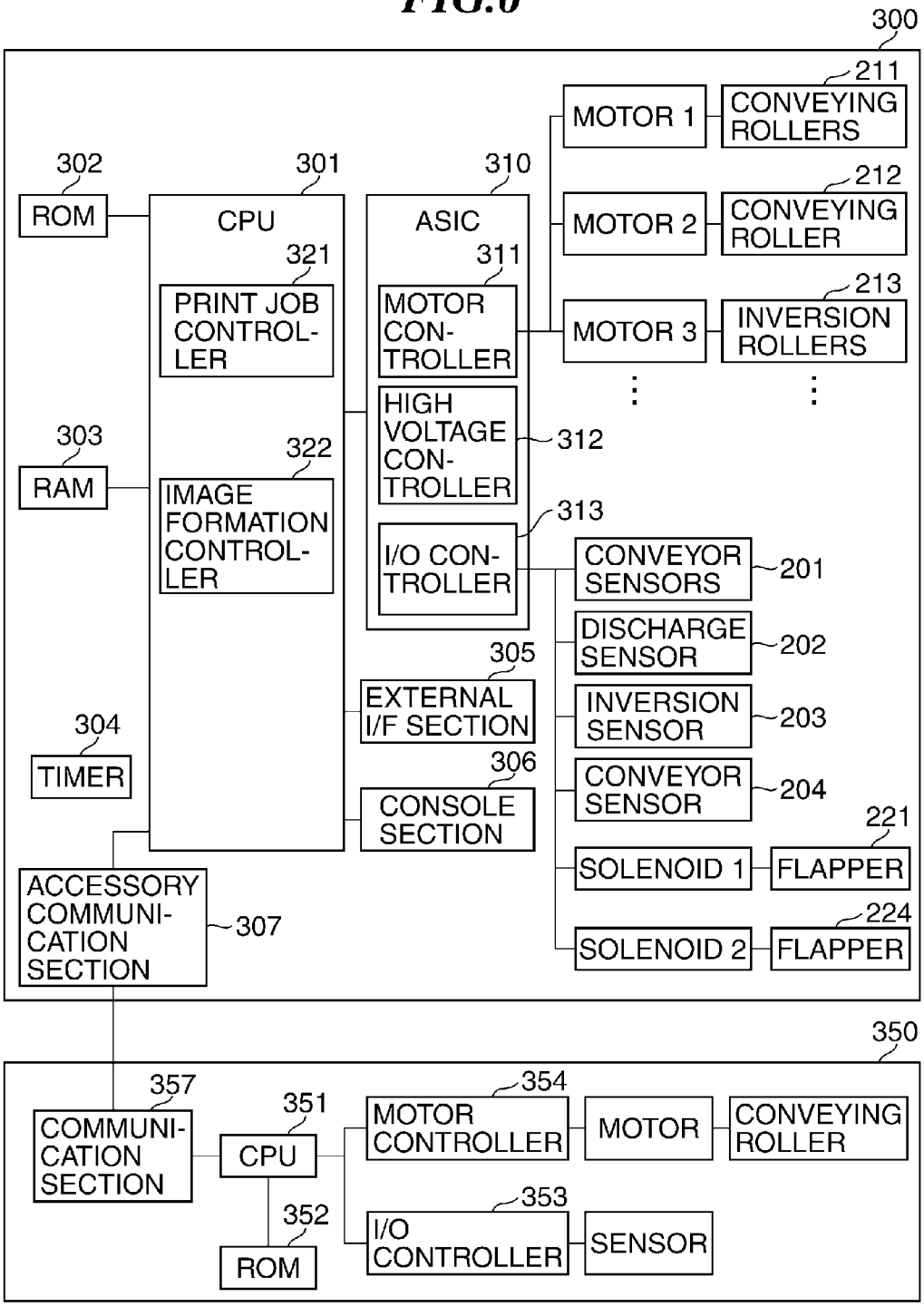
FIG. 6 is a block diagram schematically showing the configuration of a control system of the image forming apparatus and a sheet post-processing.

FIG. 6 is a block diagram schematically showing the configuration of a control system of the image forming apparatus of the present embodiment and the sheet post-processing.

The image forming apparatus 300 includes a CPU 301 that controls the overall operation of the image forming apparatus 300, a ROM 302 storing programs, data, and so forth required for control operations by the CPU 301, a RAM 303 holding settings and the like required for the control operations, and a timer 304. The CPU 301 functions as a print job controller 321 and an image formation controller 322 as well. The print job controller 321 analyzes the contents of a print job and determines the order of pages to be printed. The image formation controller 322 cooperates with an ASIC 310, described hereinafter, to control image formation on sheets and sheet conveyance. Further, the image forming apparatus 300 includes an external interface section 305 for communication with an external apparatus, a console section 306 for receiving user input, an accessory communication section 307 for communication with an external sheet feeder and discharger, and the ASIC 310 equipped with controller functions for controlling components of the image forming apparatus 300.

The ASIC 310 comprises a motor controller 311 for driving various motors, a high voltage controller 312 for controlling high voltage for development, charging, transfer, etc., and an input/output (I/O) controller 313 that controls input from sensors and output to solenoids.

The motor controller 311 controls the driving of each of a plurality of motors for use in the image forming apparatus. Each of the motors has a conveying roller connected thereto, and the motor controller 311 controls the speed and rotational direction of each of the motors, whereby the speed and rotational direction of each of the conveying rollers 211 to 219 appearing in FIG. 2 can also be controlled.

Connected to the I/O controller 313 are the sensors 201 to 204 appearing in FIG. 2, and the CPU 301 receives changes in sensor signals via the I/O controller 313. Further, each of the solenoids for controlling the respective flappers 221 and 224 is also connected to the I/O controller 313 to perform flapper control according to an instruction from the CPU 301.

It should be noted that the print job controller 321 and the image formation controller 322 may be formed by respective separate CPUs, or one controller integrating both the functions of the respective controllers 321 and 322 may be formed by one CPU. Alternatively, a single controller may be configured to integrate both the functions of the ASIC 310 and the CPU 301.

The sheet post-processing apparatus 350 comprises a communication section 357, a CPU 351, a ROM 352, an input/output (I/O) controller 353, and a motor controller 354. The CPU 351 controls the operation of the sheet post-processing apparatus 350 while communicating with the CPU 301 of the image forming apparatus via the communication section 357.

Figure 7:
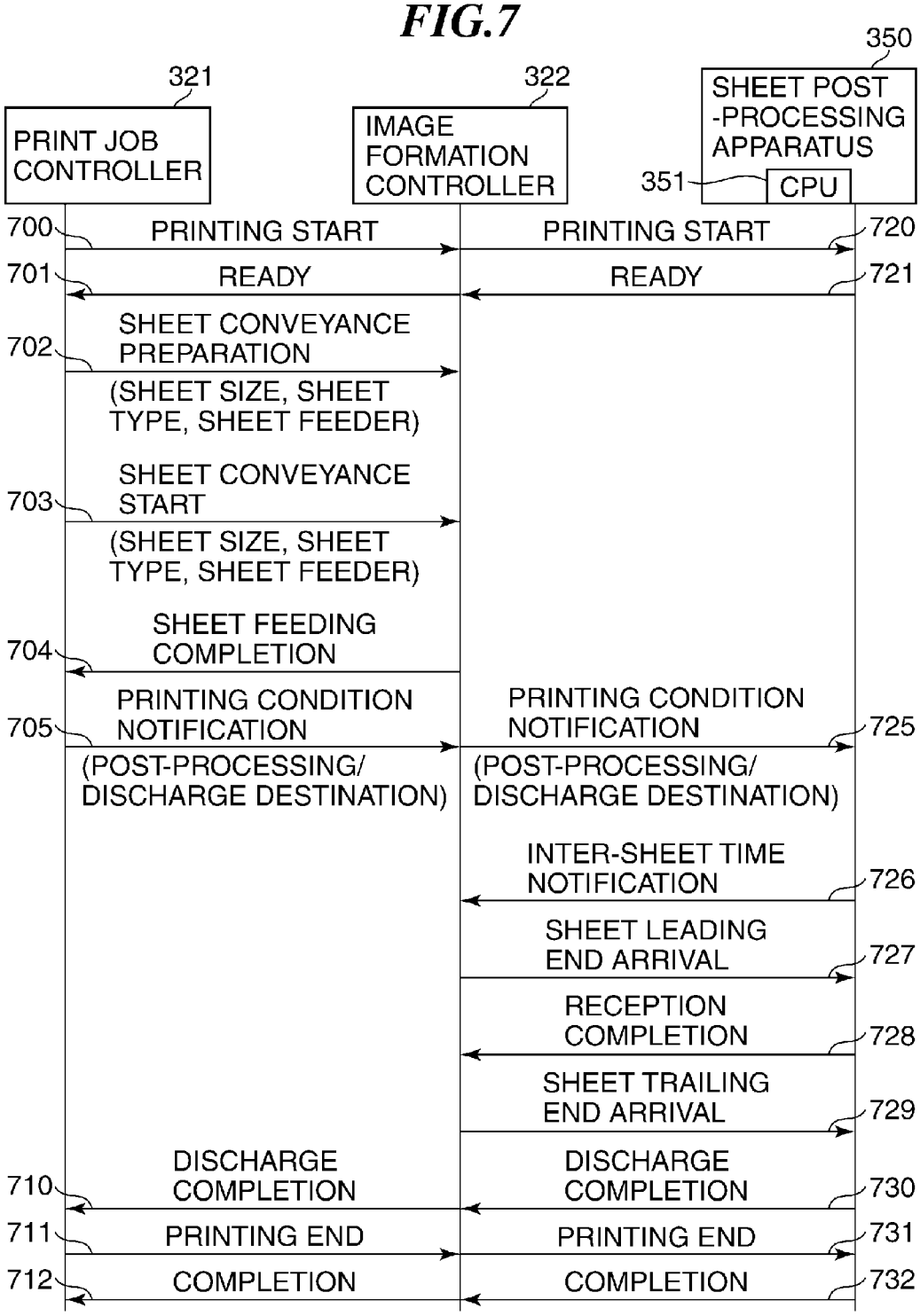
FIG. 7 is a diagram useful in explaining command exchange between a print job controller, an image formation controller, and the sheet post-processing apparatus, which is performed in a case where a single sheet is passed.
Figure 9:
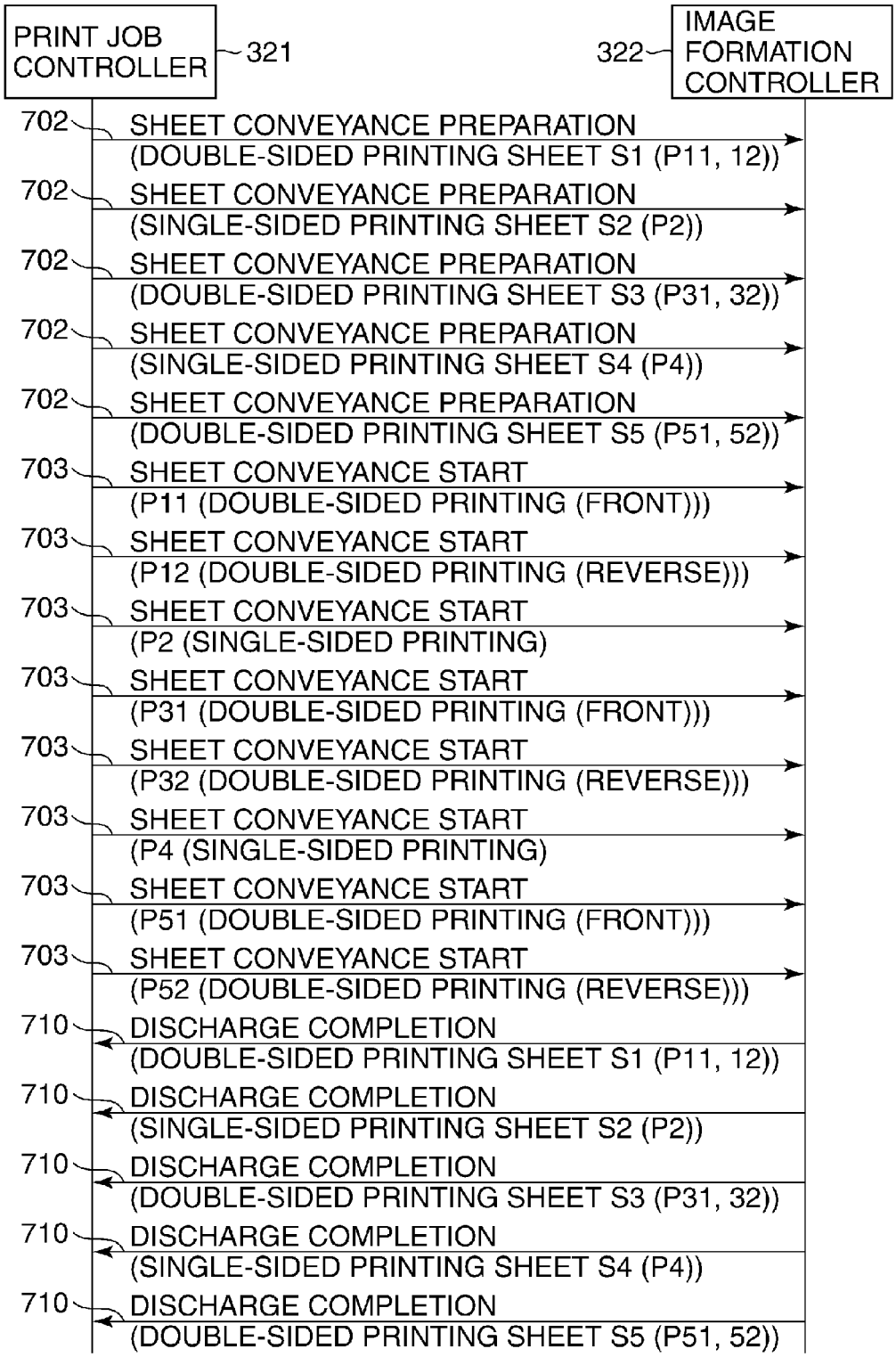
FIG. 9 is a diagram useful in explaining command exchange between the print job controller and the image formation controller, which is performed in a case where a plurality of sheets are passed.

FIG. 7 is a diagram illustrating command exchange between the print job controller 321, the image formation controller 322, and the sheet post-processing apparatus (CPU 351).

For example, when an instruction for one-page printing is received from a PC via the external interface section 305, the print job controller 321 sends a printing start command 700 to the image formation controller 322. When receiving the printing start command 700, the image formation controller 322 sends a printing start command 720 to the CPU 351 of the sheet post-processing apparatus 350. When the sheet post-processing apparatus 350 becomes ready to receive a sheet, the CPU 351 sends a ready command 721 to the image formation controller 322, and the image formation controller 322 sends a ready command 701 to the print job controller 321.

When receiving the ready command 701, the print job controller 321 sends a sheet conveyance preparation command 702 to the image formation controller 322 to instruct the image formation controller 322 to prepare for sheet conveyance. The sheet conveyance preparation command 702 contains information including a designated sheet size, a designated sheet type, and a designated sheet feeder. The image formation controller 322 makes preparations for sheet feeding according to the sheet conveyance preparation command 702. Then, the print job controller 321 sends a sheet conveyance start command 703 to the image formation controller 322 in predetermined timing, and the image formation controller 322 starts sheet feeding. When the sheet feeding is completed, the image formation controller 322 sends a sheet feeding completion command 704 to the print job controller 321.

It should be noted that in the case of performing printing for a plurality of pages, the print job controller 321 issues the sheet conveyance preparation command 702 for each of the sheets so as to cause the image formation controller 322 to make preparations for sheet feeding before sheet conveyance is started.

In the present embodiment, it is assumed that the sheet conveyance preparation command is issued for each of sheets in the order of discharge thereof, and the sheet conveyance start command is issued for each of pages in the order of feeding thereof.

When receiving the ready command 721 from the CPU 351, the CPU 301 sends a printing condition notification command 725 to the CPU 351. The printing condition notification command 725 contains information including the type of a post-processing operation and a discharge destination. The CPU 351 sends an inter-sheet time period notification command 726 notifying a time period required for processing the sheet to the CPU 301 according to received conditions.

The CPU 301 controls sheet discharge timing according to the received inter-sheet time period notification command 726 and sends a sheet leading end arrival command 727 to the CPU 351 immediately before the leading end of the sheet reaches the sheet post-processing apparatus 350. The CPU 351 sends to the CPU 301 a reception completion command 728 indicative of whether or not the sheet has been normally received.

Further, the image formation controller 322 sends a sheet trailing end arrival command 729 to the CPU 351 immediately before the trailing end of the sheet reaches the sheet post-processing apparatus 350. The CPU 351 sends to the image formation controller 322 a discharge completion command 730 indicative of whether or not the sheet has been normally discharged. The image formation controller 322 sends a discharge completion command 710 to the print job controller 321. When all printing is completed, the print job controller 321 sends a printing end command 711 to the image formation controller 322. The image formation controller 322 sends a printing end command 731 to the CPU 351.

Then, the image formation controller 322 receives a completion command 732 from the CPU 351, and sends a completion command 712 to the print job controller 321 upon completion of stop processing within the image forming apparatus. Thus, the print job is completed.

Next, a description will be given, with reference to FIGS. 8 to 13, of normal control and passing control performed in a case where a job mixedly involving single-sided printing and double-sided printing is executed.

The following description will be given of a job for printing a double-sided printing sheet (sheet S1), a single-sided printing sheet (sheet S2), a double-sided printing sheet (sheet S3), a single-sided printing sheet (sheet S4), and a double-sided printing sheet (sheet S5) in the mentioned order. In the present example, the front and reverse pages of the sheet S1 are represented by P11 and P12, respectively, the front page of the sheet S2 by P2, and the front and reverse pages of the sheet S3 by P31 and P32, respectively. Further, the front page of the sheet S4 is represented by P4, and the front and reverse pages of the sheet S5 by P51 and P52, respectively.

As shown in FIG. 8, in the normal control which does not involve the passing control, image formation is performed on pages P11, P12, P2, P31, P32, P4, P51, and P52 in the mentioned order. Now, a description will be given, with reference to FIG. 9, of the sending order of the sheet conveyance preparation command and the sheet conveyance start command exchanged between the print job controller and the image formation controller in the above-mentioned case.

Prior to the sheet conveyance start command 703, the sheet conveyance preparation command 702 is issued for each of sheets i.e. on a sheet-by-sheet basis in the order of S1, S2, S3, S4, and S5 (the sheet conveyance preparation command 702 is a command requesting preparation for start of sheet conveyance, and therefore it is issued on a sheet-by-sheet basis). Then, the sheet conveyance start command 703 is issued for each of pages i.e. on a page-by-page basis in the order of P11, P12, P2, P31, P32, P4, P51, and P52, and image formation and sheet conveyance are performed in the mentioned order of the sheets.

Figure 10:
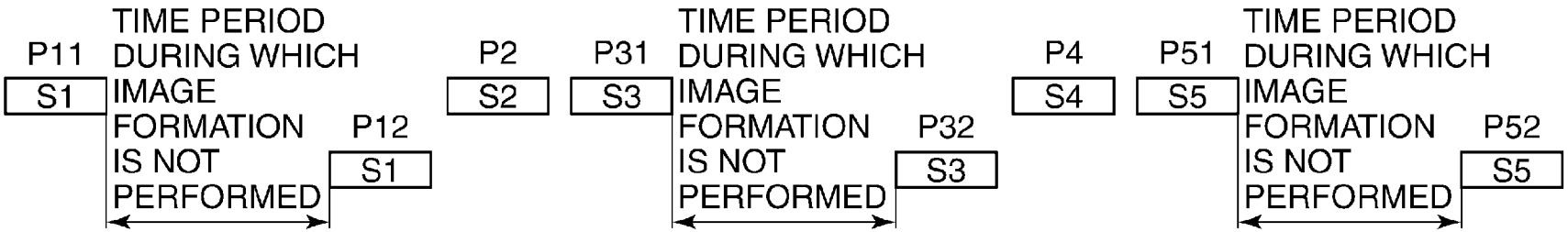
FIG. 10 is a schematic diagram useful in explaining image forming time intervals in the normal control.

In a case where image formation is performed in the above-mentioned order, after an image for the page P31 is transferred onto the front side of the sheet S3 by the transfer section 6, the sheet S3 is conveyed into the double-sided path 22 and is conveyed again to the transfer section 6, and then an image for the page P32 is transferred onto the reverse side of the sheet 3. For this reason, the image forming time interval increases as shown in FIG. 10, which causes reduction of productivity.

To solve this problem, the page P31 (S3 (front) for double-sided printing) is subjected to image formation prior to the page P12 (S1 (reverse) for double-sided printing) and the page P2 (S2 for single-sided printing), as shown in FIG. 11.

Figure 12:
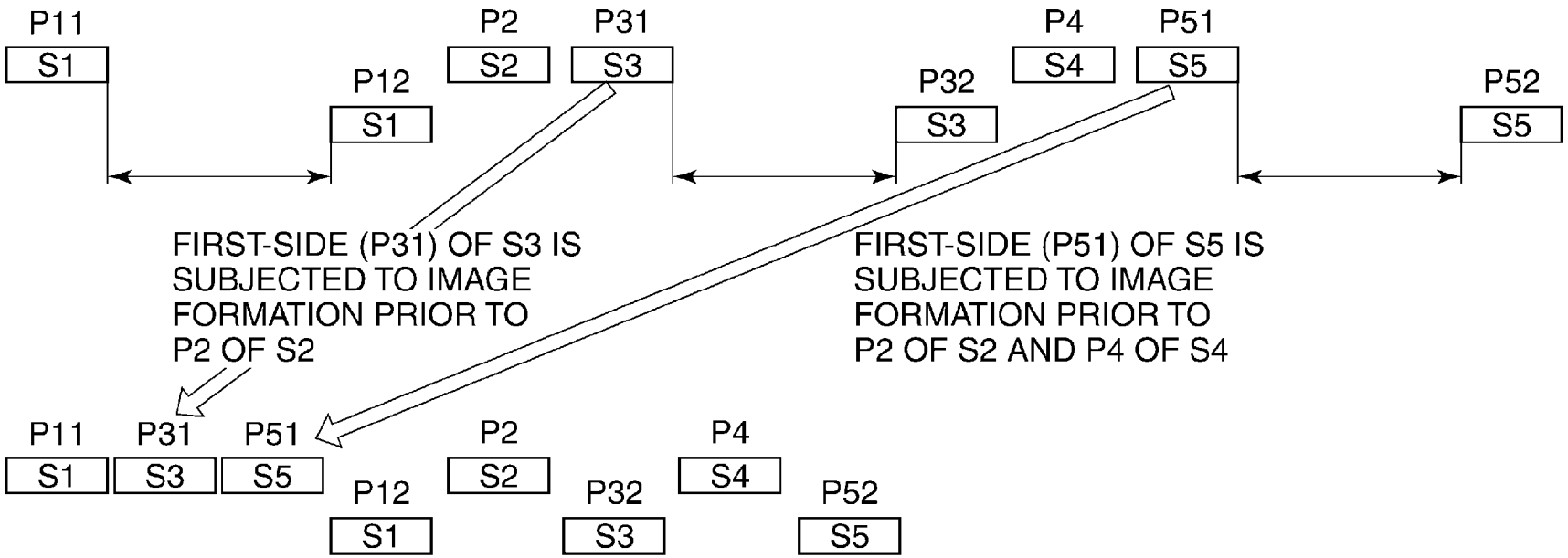
FIG. 12 is a schematic diagram useful in explaining image forming time intervals in the passing control.

As shown in FIG. 12, the pages P31 and P51 are subjected to image formation prior to the page P2 during a conveying time period taken between completion of image formation on the page P11 and start of image formation on the page P12, so that the image forming time interval does not increase. Thus, by executing the passing control, it is possible to reduce the total printing time.

Figure 13:
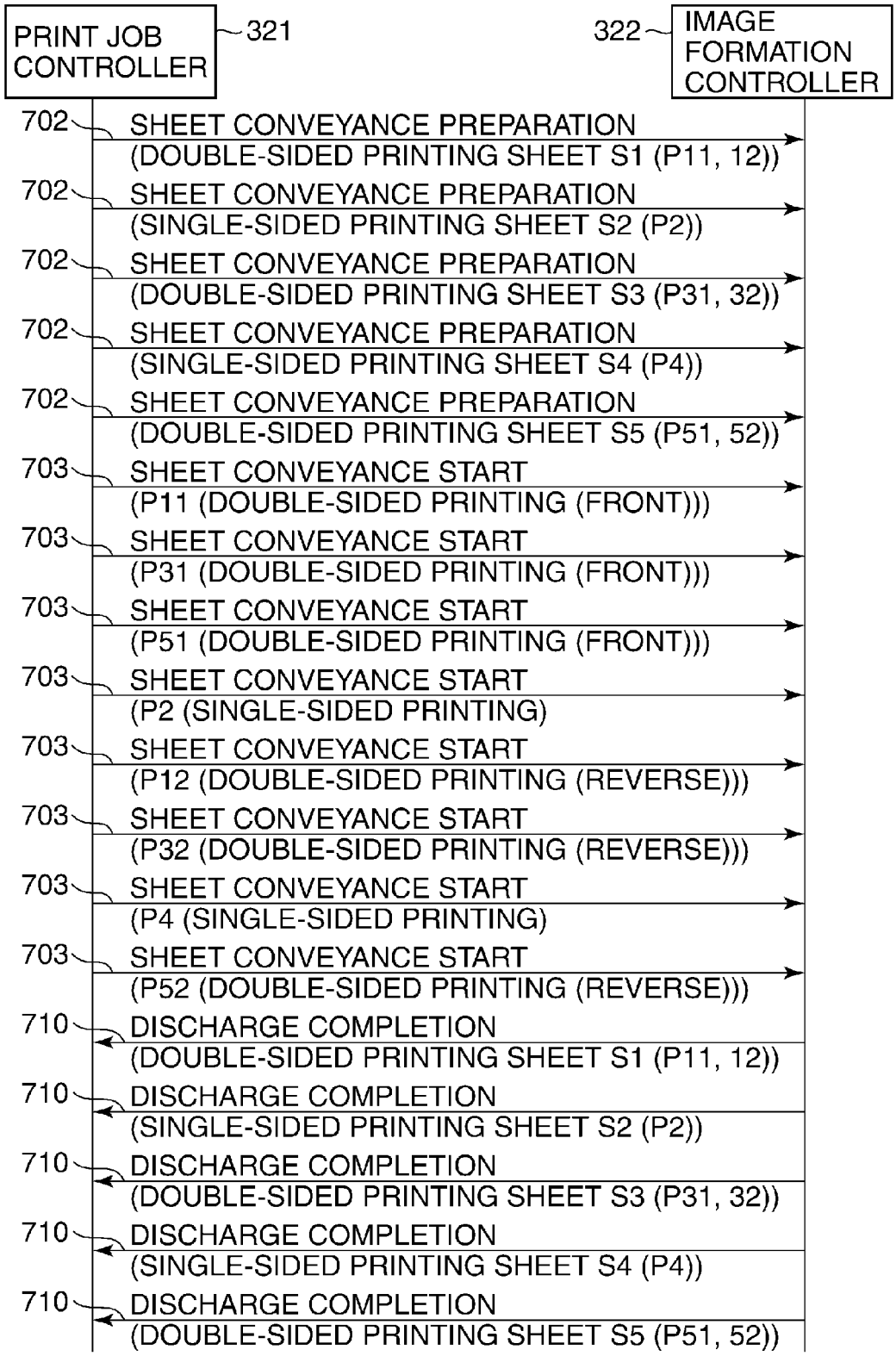
FIG. 13 is a sequence diagram useful in explaining command exchange which is performed between the print job controller and the image formation controller in the passing control.

A description will be given, with reference to FIG. 13, of transmission of commands exchanged between the print job controller 321 and the image formation controller 322 in a case where the control shown in FIG. 12 is executed.

The sheet conveyance preparation command 702 is issued prior to the sheet conveyance start command 703 for each of sheets in the order of S1, S2, S3, S4, and S5 as in the normal control. On the other hand, the sheet conveyance start command 703 is issued for each of pages in the order of P11, P31, P51, P12, P2, P32, P4, and P52, and image formation and sheet conveyance are performed in the mentioned order, whereby the passing control can be executed.

Figure 14:
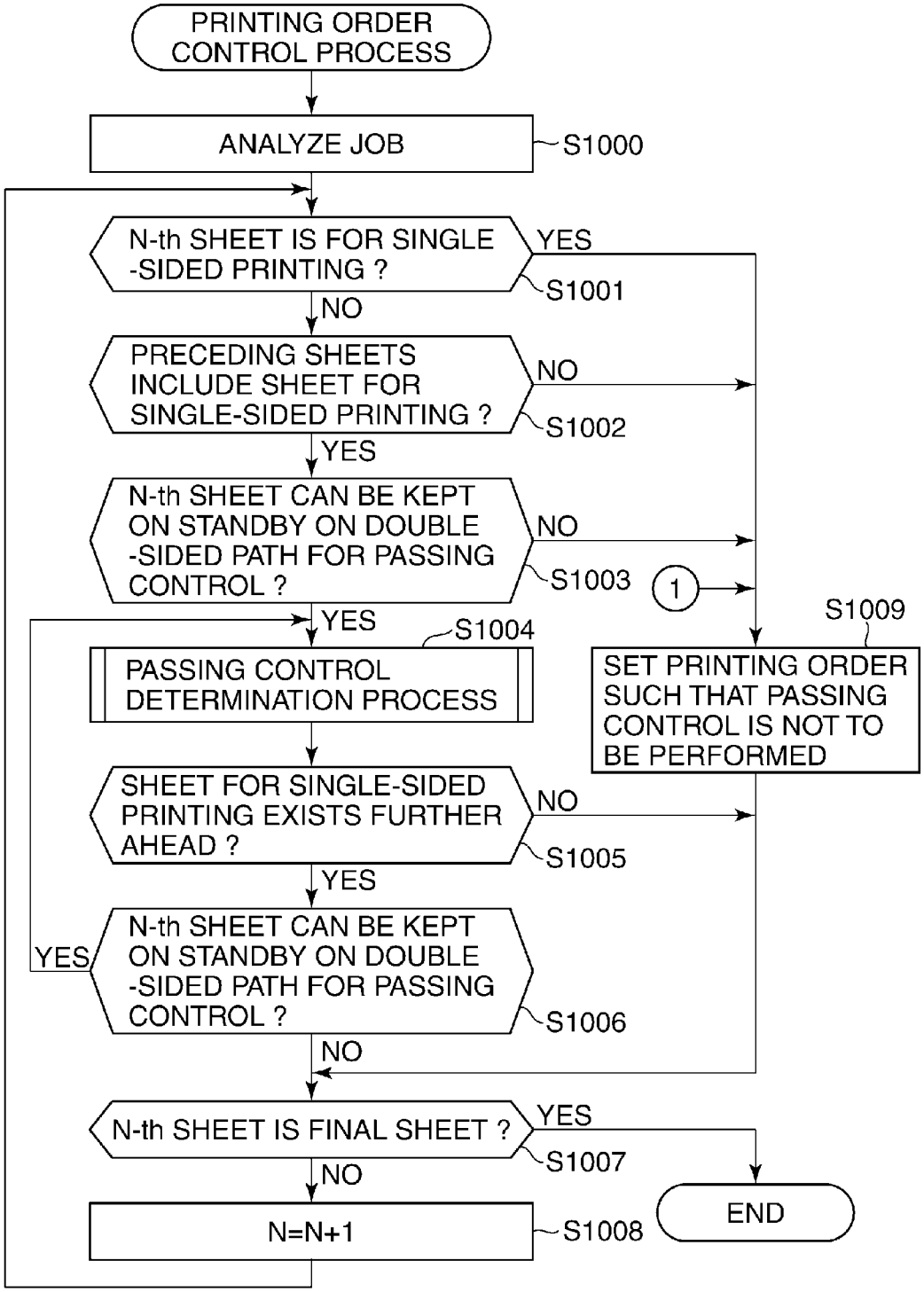
FIG. 14 is a flowchart of a printing order control process in the passing control.
Figure 15:
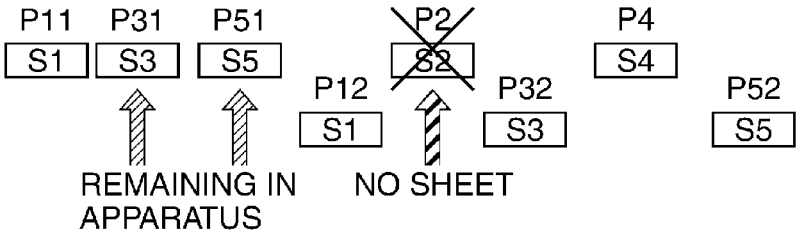
FIG. 15 is a schematic diagram useful in explaining illustrating an exemplary case where a wrong page order is caused by the passing control.

Now, a printing order control process in the passing control will be described with reference to FIG. 14. FIG. 14 is a flowchart of the printing order control process executed by the print job controller 321.

First, the print job controller 321 analyzes the contents of a received print job to determine, on a sheet-by-sheet basis, which of double-sided printing and single-sided printing is to be performed, and set a variable N indicative of what number-th sheet to 1 (step S1000). The print job controller 321 determines whether or not an N-th sheet is for single-sided printing (step S1001). If the N-th sheet is for single-sided printing, the print job controller 321 sets the printing order to an order which does not involve the passing control, i.e. an order corresponding to the page order (step S1009). If the N-th sheet is for double-sided printing, the print job controller 321 determines whether or not sheets corresponding to the preceding pages include a sheet for single-sided printing (step S1002). If the sheets corresponding to the preceding pages do not include a sheet for single-sided printing, the print job controller 321 sets the printing order to an order which does not involve the passing control, i.e. such that, as shown in FIG. 5, the first sides of double-sided printing sheets of a number that can be kept on standby on the double-sided path 22 are printed, and then second-side printing and first-side printing are performed alternately (step S1009). If the preceding sheets corresponding to the preceding pages include a sheet for single-sided printing, the print job controller 321 determines whether or not the N-th sheet can be kept on standby on the double-sided path 22 for execution of the passing control (step S1003). If it is not possible to keep the N-th sheet on standby on the double-sided path 22, the print job controller 321 sets the printing order such that the passing control is not to be performed (step S1009). A state in which the N-th sheet cannot be kept on standby corresponds to a state in which a predetermined number of pages have been set to be subjected to the passing control prior to the N-th sheet. This predetermined number corresponds to the number of sheets that can be kept on standby on the double-sided path 22, and in the present embodiment, the number is set to three. In other words, it is determined in the step S1003 whether or not there are a predetermined number of pages set to be subjected to the passing control after the single-sided printing sheet. If the N-th sheet can be kept on standby on the double-sided path 22, the print job controller 321 executes a passing control determination process for determining whether to perform the passing control (S1004).

Figure 16:
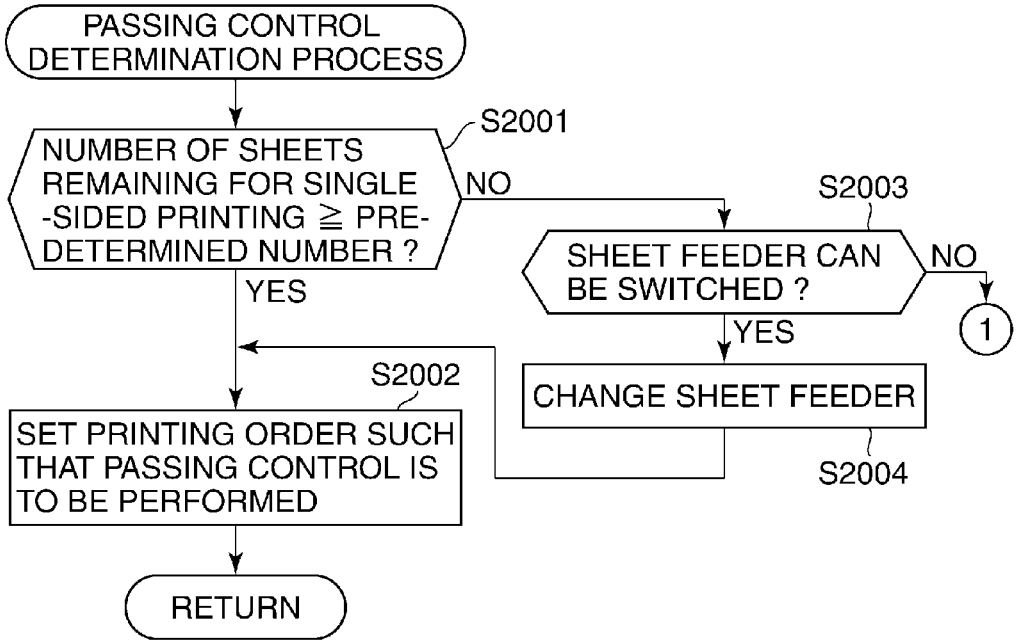
FIG. 16 is a flowchart of a passing control determination process executed in a step in the printing order control process.

The passing control determination process will be described with reference to FIG. 16. FIG. 16 is a flowchart showing details of the step S1004 in detail. The print job controller 321 determines whether or not the number of preceding single-sided printing sheets remaining in an associated sheet feeder (one of the sheet feeders 5*a* to 5*c* in the example of FIG. 1) is larger than a predetermined number (step S2001). If the number of the sheets remaining in the sheet feeder is larger than the predetermined number, the print job controller 321 sets the printing order such that the passing control is to be performed (step S2002). More specifically, the printing order is set such that the front side of the N-th sheet is printed prior to the preceding page for single-sided printing. As a consequence, as illustrated in FIG. 13 by way of example, the sheet conveyance start command 703 is sent for the page P51 prior to the sheet conveyance start command for each of the pages P2 and P4. On the other hand, if the number of sheets remaining in the sheet feeder is not larger than the predetermined number, the print job controller 321 determines whether or not there is another sheet feeder containing more sheets of the same type than the predetermined number (step S2003). In other words, the print job controller 321 determines whether or not it is possible to perform sheet feeder switching. If it is possible to perform sheet feeder switching, the print job controller 321 switches the currently used sheet feeder (e.g. sheet feeder 5*a*) to another sheet feeder (e.g. sheet feeder 5*b*) for feeding sheets for single-sided printing (step S2004) and then sets the printing order such that the passing control is to be performed (step S2002). If it is not possible to perform sheet feeder switching, the process proceeds to the step S1009, wherein the print job controller 321 sets the printing order such that the passing control is not to be performed.

Now, a description will be given of why the number of remaining sheets is taken into consideration. Let it be assumed that the passing control is performed such that the pages P31 and P51 are printed prior to the single-sided printing page P2. When the absence of sheets occurs for the sheet S2 after the sheets S3 and S5 have been fed prior to the sheet S2 so as to print the pages P31 and P51, and image formation on the sheets S3 and S5 already fed is continued, a product without the page P2 is created. However, if image formation is suspended, the sheets S3 and S5 remain as residual sheets in the apparatus without being discharged. This necessitates work for removing the residual sheets, which degrades operability.

Figure 17:
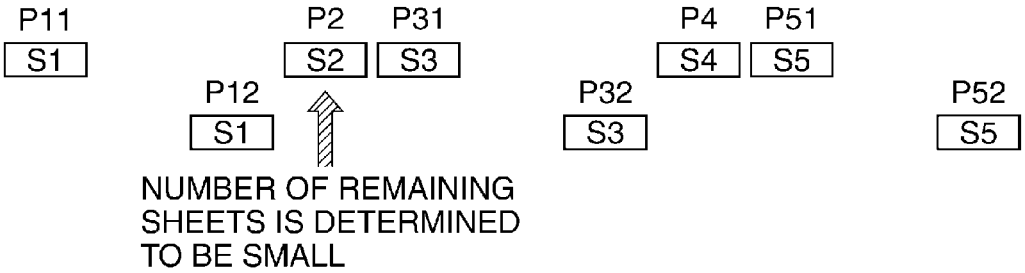
FIG. 17 is a schematic diagram illustrating an exemplary case where the wrong page order to be caused by the passing control is prevented.

To solve this problem, in the present embodiment, it is determined whether or not the passing control is to be performed while taking into account the number of remaining sheets. In the present embodiment, it is determined by a residual sheet count sensor 51 (see FIG. 1) provided for the associated sheet feeder whether or not the number of remaining sheets is smaller than a predetermined number (e.g. 10 sheets). If the number of the remaining sheets is less than 10, it is predicted that it will become impossible to supply sheets for printing pages passed during the passing control, and therefore the print job controller 321 sets the printing order in advance such that the passing control is not to be performed. For example, when the number of remaining sheets when the page P2 is to be printed is less than 10, the print job controller 321 sets the printing order as shown in FIG. 8. In this case, even if sheets have run out during printing of the page P2, a product with wrong page order cannot be created due to suspension of image formation, because image formation has not yet been performed on pages following the page P2. The pages are subjected to image formation in an order illustrated in FIG. 17.

Referring again to the FIG. 14 flowchart, the print job controller 321 determines whether or not a sheet for single-sided printing exists ahead of the above-mentioned single-sided printing page (step S1005). For example, in a case where the printing order is set such that the double-sided printing page P51 appearing in the lower part of FIG. 12 passes the single-sided printing page P4, the single-sided printing page P2 preceding the page P4 corresponds to the mentioned sheet. If the answer to the question of the step S1005 is affirmative (YES), the print job controller 321 determines whether or not the N-th sheet can be kept on standby on the double-sided path 22 for the passing control (step S1006). Specifically, it is determined, as in the step S1003, whether or not the predetermined number of pages set to be subjected to the passing control exist between the further preceding single-sided printing page and the N-th sheet. If the answer to the question of the step S1006 is affirmative (YES), the print job controller 321 executes the passing control determination process described above again (step S1005). If the answer to the question of the step S1006 is negative (NO), the print job controller 321 determines whether or not the N-th sheet corresponds to a final page of the present job (step S1007). If the N-th sheet does not correspond to the final page, the variable N is incremented by 1 (step S1008), and the steps S1001 et seq. are repeatedly executed on a next sheet. If the N-th sheet corresponds to the final page, the printing order control process is terminated.

It should be noted that in the passing control determination process in FIG. 16, an abnormal state of the image forming apparatus is predicted based on the number of remaining sheets. However, an abnormal state of the image forming apparatus may be predicted based on shortage of consumables (fixing web, ITB web, toner), a full state of a waste box (a waste tone box, a punch chip box, a sheet cutting chip box, or a stapling cuttings box), and so forth to thereby determine whether or not to perform the passing control. Alternatively, an abnormal state of the image forming apparatus may be predicted based on the number of sheets discharged and accumulated on a discharge tray after having been subjected to image formation.

Figure 18:
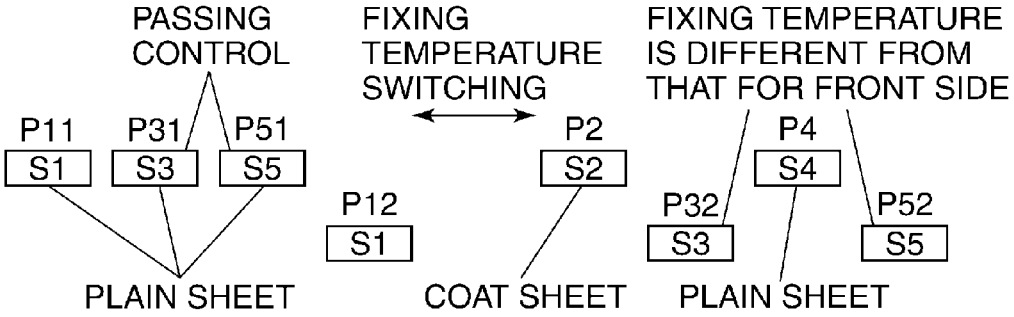
FIG. 18 is a schematic diagram illustrating an exemplary case where an image quality abnormality is caused by the passing control.

A description will be given of a process for determining whether or not to perform the passing control, except depending on the prediction of an abnormal state of the image forming apparatus. For example, let it be assumed that the sheet S1 is plain paper, the sheet S2 is coat paper, and the sheets S3, S4, and S5 are plain paper, as shown in FIG. 18.

In this case, when the passing control is executed, it is required to execute a target fixing temperature switching control for printing on the page P2, which is a coat sheet, after execution of first-side printing on the page P51. Since time for changing fixing temperature is required, timing for feeding the sheet S2 is delayed so as to make a time interval between the page P12 and the page P2 longer than it normally is. After completion of the temperature switching control, printing is performed on the page P2, and then the page P32 is printed in succession. In general, it is also possible to perform printing on a plain sheet at a target fixing temperature for coat paper. However, if printing on the page P32 is performed after execution of printing on the page P2 while maintaining the target fixing temperature for coat paper e.g. when an operation mode in which importance is attached to productivity is set in advance, the target fixing temperature becomes different between the front and reverse sides of the same sheet, and hence there is a fear that the same image quality cannot be maintained for the front and reverse sides of the sheet.

Figure 19:
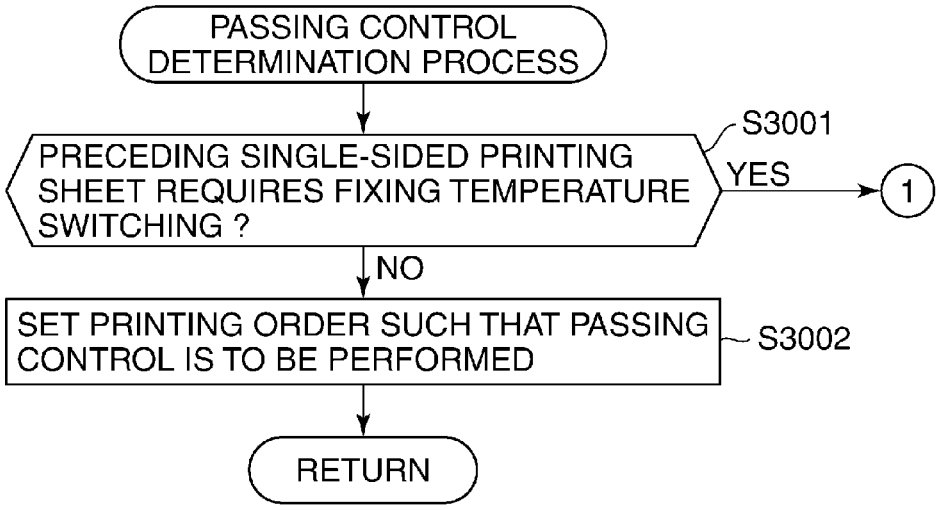
FIG. 19 is a flowchart of a variation of the passing control determination process which prevents occurrence of the image quality abnormality caused by the passing control.
Figure 20:
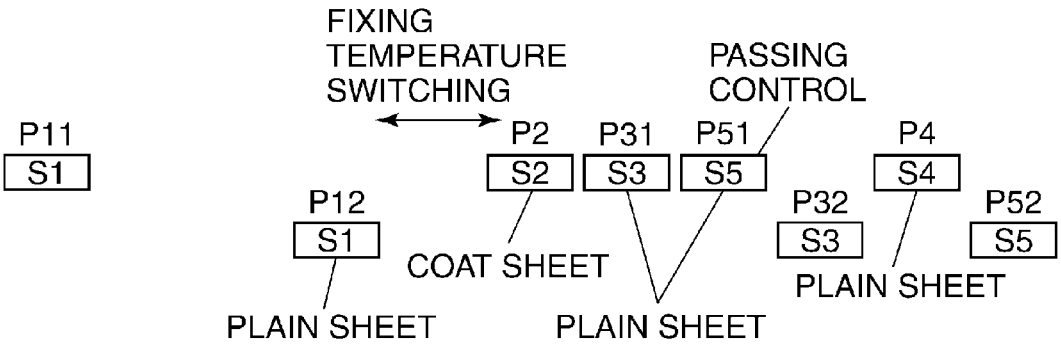
FIG. 20 is a schematic diagram illustrating an exemplary case where the occurrence of the image quality abnormality to be caused by the passing control is prevented.

To solve this problem, a variation of the passing control determination process as illustrated in FIG. 19 is executed in the step S1004 of the FIG. 14 flowchart. The print job controller 321 determines whether or not the preceding single-sided printing sheet requires the target fixing temperature switching control (S3001). If the target fixing temperature switching control is required (Yes to the step S3001), the print job controller 321 sets the printing order such that the passing control is not to be performed (S1009 in FIG. 14). On the other hand, if the target fixing temperature switching control is not required (No to the step S3001), the print job controller 321 sets the printing order such that the passing control is to be performed (step S3002). It should be noted that the double-sided printing sheet S5 and the single-sided printing sheet S4 are both plain paper as shown in FIG. 20, so that the target fixing temperature switching control is not required between the sheets S5 and S4. Therefore, the passing control in which the page P51 is subjected to image formation prior to the page P4 becomes executable to improve productivity. When target fixing temperature switching takes place as described above, the passing control is inhibited, thereby preventing the target fixing temperature for the front side of the sheet and that for the reverse side of the same from becoming different. This makes it possible to maintain the same image quality for the front and reverse sides of the same sheet.

Although in this variation, the passing control is also inhibited when the target fixing temperature switching occurs is described, the passing control may be also inhibited when control switching due to other factors, such as switching between the monochrome printing mode and the full color printing mode, occurs. Further, the passing control may be also inhibited in timing in which a calibration operation is performed whenever a predetermined number of sheets are subjected to image formation.

Whether or not to execute the passing control may be determined based depending on both prediction of an abnormal state of the image forming apparatus in the embodiment, and occurrence of control switching in the variation thereof.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2010-113127 filed May 17, 2010, which is hereby incorporated by reference herein in its entirety.

What is claimed is:

1. An image forming apparatus comprising:

an image forming section configured to print on a sheet;

a sheet feeding section configured to feed sheets one by one to the image forming section for printing on a first side thereof;

a re-feeding section configured to, when double-sided printing is to be performed, re-feed the fed sheets to the image forming section for printing on a second side thereof; and a control section configured to perform, when there is a page of double-sided printing, which is posterior to a page of single-sided printing, a passing control where a sheet for the page of double-sided printing is fed and printed with the page of double-sided printing on the first side thereof before a sheet for the page of single-sided printing is fed and printed on the first side thereof, wherein when an occurrence of a state is predicted, where the sheet for the page of single-sided printing, which is to be fed and printed after the sheet for the page of double-sided printing in the passing control, cannot be fed, the control section does not perform the passing control so that the page of single-sided printing, instead of the page of double-sided printing, printed on the sheet to be fed and printed with the page of double-sided printing, after the image forming section has completed printing on all already fed sheets re-fed from the re-feeding section.

2. The image forming apparatus according to claim 1, wherein the state is a state in which a number of sheets contained in the sheet feeding section is not more than a predetermined number.

3. The image forming apparatus according to claim 1, wherein the state is a state in which consumables provided in the image forming apparatus are insufficient.

4. The image forming apparatus according to claim 1, wherein the state is a state in which a container for waste produced in the image forming apparatus is full.

5. The image forming apparatus according to claim 1, wherein in a case where double-sided printing is performed on a plurality of sheets without performing the passing control, the control section controls double-sided printing so that the first sides of a predetermined number of fed sheets are continuously printed, and then a page of a sheet re-fed from the re-feeding section and the first side of a sheet fed anew from the sheet feeding section are alternately printed.

6. The image forming apparatus according to claim 1, wherein, in the passing control, the control section changes an image forming order so that the sheet for the page of double-sided printing is fed and printed with the page of double-sided printing on the first side thereof before the sheet for the page of single-sided printing is fed and printed with the page of single-sided printing on the first side thereof.

* * * * *